US006646527B1

(12) United States Patent
Dove et al.

(10) Patent No.: US 6,646,527 B1
(45) Date of Patent: Nov. 11, 2003

(54) HIGH FREQUENCY ATTENUATOR USING LIQUID METAL MICRO SWITCHES

(75) Inventors: Lewis R Dove, Monument, CO (US); John R Lindsey, Tokyo (JP); David J Dascher, Monument, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 50 days.

(21) Appl. No.: 10/136,147

(22) Filed: Apr. 30, 2002

(51) Int. Cl.[7] ..... H01H 29/00
(52) U.S. Cl. ..... 335/47; 200/181
(58) Field of Search ..... 335/47–54, 78–86; 200/181–236; 257/414–421

(56) References Cited

U.S. PATENT DOCUMENTS 3,600,537 A * 8/1971 Twyford ..... 200/407
6,323,447 B1 * 11/2001 Kondoh et al. ..... 200/182
6,396,371 B2 * 5/2002 Streeter et al. ..... 335/78
6,501,354 B1 * 12/2002 Gutierrez et al. ..... 335/47

* cited by examiner

*Primary Examiner*—Tuyen T. Nguyen
(74) *Attorney, Agent, or Firm*—Edward L. Miller

(57) ABSTRACT

Resonance within an attenuator relay caused by stray coupling capacitances to, and stray reactance within the switched conductor that replaces the attenuator section, is mitigated by reducing the stray coupling capacitances to as low a value as possible, and by using a conductor that is a section of controlled impedance transmission line that matches the system into which the attenuator relay has been placed. A substrate having SPDT LIMMS switches on either side of a switched transmission line segment and its associated attenuator, all of which are fabricated on the substrate, will have significantly lower stray coupling capacitance across the open parts of the switches when the attenuator segment is in use. This will increase the frequency for the onset of the resonance driven by the RF voltage drop across the attenuator. A reduction in the amplitude of the resonance can be obtained by including on the substrate an additional pair of LIMMS damping switches at each end of the transmission line segment. These damping switches each connect a terminating resistor to the ends of the transmission line segment when the attenuator section is in use. This loads the resonator and reduces the amplitude of the resonance. Still further improvement can be obtained by locating one of the damping switches and its termination resistor near (but preferably not exactly at) the middle of the transmission line segment.

10 Claims, 10 Drawing Sheets

HIGH FREQUENCY ATTENUATOR USING LIQUID METAL MICRO SWITCHES

REFERENCE TO RELATED PATENT

The subject matter of this Application is related to that disclosed in U.S. Pat. No. 6,323,447 B1 entitled ELECTRICAL CONTACT BREAKER SWITCH, INTEGRATED ELECTRICAL CONTACT BREAKER SWITCH, AND ELECTRICAL CONTACT SWITCHING METHOD, issued Nov. 27, 2001. The subject matter described in the instant Application is a refinement and further application of the subject matter of U.S. Pat. No. 6,323,447 B1, and for brevity in the description herein of background technology used as a point of departure, U.S. Pat. No. 6,323,447 B1 is hereby expressly incorporated herein by reference, for all that it discloses.

BACKGROUND OF THE INVENTION

RF step attenuators are an important part of many general purpose electronic instruments such as spectrum analyzers, network analyzers, S-parameter test sets, signal generators, sweep generators, and high frequency oscilloscopes, just to name a few. Special purpose test sets, such as those used to test wireless communications equipment are also important users of RF step attenuators. Decades ago an RF step attenuator was a manually operated device: the human hand generally turned a knob. With the advent of automated test systems under computer control, and the more recent advent of automatic test equipment that has its own internal processor, has a sophisticated repertoire of testing abilities, and has extensive instrument-to-instrument communication abilities, the need for attenuators that are electrically controlled has steadily grown, and continues to do so. The increases in performance, both in accuracy and in higher frequencies of operation, have placed additional demands upon the nature of the desired attenuators. Furthermore, stand-alone instrument grade programmable (solenoid operated) step attenuators usable in the microwave region are simply too big and too costly for many of today's designs, where much of the circuitry is integrated.

One prior art response to this situation is represented by the A150 line of ultra-miniature attenuator relays from Teledyne (www.teledynerelays.com—12525 Daphne Avenue, Hawthorne, Calif., 90250). They are small, approximately three-eighths by seven-sixteenths of an inch in length and width by less than a third of an inch in height. They are usable to 3 GHz, have an internal matched thin film attenuator (pad) available in Pi, T or L sections, and are available in a variety of attenuations of from 1 dB to 20 dB. This family of relays provides the "step" in attenuation by replacing the pad with a length of conductor. The mechanical arrangement for doing this is set out in U.S. Pat. No. 5,315,723, issued May 24, 1994 and entitled ATTENUATOR RELAY. It does not appear that the length of conductor that replaces the pad is a section of genuine controlled impedance transmission line.

FIG. 1 is a generalized representation of a prior art step attenuator relay 1, such as the A150 attenuator relay. An RF input 2 is coupled to the moving pole of a SPDT switch 4, and an RF output 3 is taken from the moving pole of a SPDT switch 5. Switches 4 and 5 are operated together by the solenoid of the relay (not shown), with the effect that either an attenuator section 6 or a conductor 7 is connected between the RF input 2 and the RF output 3. It is not so much that this arrangement is defective, it works up to some upper frequency where geometry begins to significantly influence circuit behavior. At higher frequencies the stray coupling capacitances 10 and 11 (which are around one hundred femto farads) allow conductor 7 to begin to shunt the attenuator 6, and RF currents will flow around the attenuator 6, driven by the voltage drop across the attenuator itself. There are minor stray reactances within the conductor 7, which we have indicated in a very general way by the series inductances 8 and the shunt capacitance 9. At higher frequencies the stray coupling capacitances 10 and 11 combine with the stray reactances 8 and 9 to form a resonant circuit that poisons the attenuation inserted by the relay 1. In the case of the A150 this happens at around 4 GHz.

Recent developments have occurred in the field of very small switches having liquid moving metal-to-metal contacts and that are operated by an electrical impulse. That is, they are actually small latching relays that individually are SPST or SPDT, but which can be combined to form other switching topologies, such as DPDT. (Henceforth we shall, as is becoming customary, refer to such a switch as a Liquid Metal Micro Switch, or LIMMS.) With reference to FIGS. 2–5, we shall briefly sketch the general idea behind one class of these devices. Having done that, we shall advance to the topic that is most of interest to us, which is a technique for fabricating on a hybrid substrate a high performance high frequency step attenuator using a collection of such relays.

Refer now to FIG. 2A, which is a top sectional view of certain elements to be arranged within a cover block 2 of suitable material, such as glass. The cover block 2 has within it a closed-ended channel 18 in which there are two small movable distended droplets (23, 24) of a conductive liquid metal, such as mercury. The channel 18 is relatively small, and appears to the droplets of mercury to be a capillary, so that surface tension plays a large part in determining the behavior of the mercury. One of the droplets is long, and shorts across two adjacent electrical contacts extending into the channel, while the other droplet is short, touching only one electrical contact. There are also two cavities 16 and 17, within which are respective heaters 14 and 15, each of which is surrounded by a respective captive atmosphere (21, 22) of an inert gas, such as $CO_2$. Cavity 16 is coupled to the channel 18 by a small passage 19, opening into the channel 18 at a location about one third or one fourth the length of the channel from its end. A similar passage 20 likewise connects cavity 17 to the opposite end of the channel. The idea is that a temperature rise from one of the heaters causes the gas surrounding that heater to expand, which splits and moves a portion of the long mercury droplet, forcing the detached portion to join the short droplet. This forms a complementary physical configuration (or mirror image), with the large droplet now at the other end of the channel. This, in turn, toggles which two of the three electrical contacts are shorted together. After the change the heater is allowed to cool, but surface tension keeps the mercury droplets in their new places until the other heater heats up and drives a portion of the new long droplet back the other way. Since all this is quite small, it can all happen rather quickly; say, on the order of milliseconds.

To continue, then, refer now to FIG. 1B, which is a sectional side view of FIG. 1A, taken A through the middle of the heaters 14 and 15. New elements in this view are the bottom substrate 13, which may be of a suitable ceramic material, such as that commonly used in the manufacturing of hybrid circuits having thin film, thick film or silicon die components. A layer 25 of sealing adhesive bonds the cover block 12 to the substrate 13, which also makes the cavities 16 and 17, passages 19 and 20, and the channel 18, all gas tight (and also mercury proof, as well!). Layer 25 may be of a material called CYTOP (a registered trademark of Ashai Glass Co., and available from Bellex International Corp., of Wilmington, Del.). Also newly visible are vias 26–29 which, besides being gas tight, pass through the substrate 13 to afford electrical connections to the ends of the heaters 14 and 15. So, by applying a voltage between vias 26 and 27, heater 14 can be made to become very hot very quickly. That in turn, causes the region of gas 21 to expand through passage 19 and begin to force long mercury droplet 23 to separate, as is shown in FIG. 3. At this time, and also before heater 14 began to heat, long mercury droplet 23 physically bridges and electrically connects contact vias 30 and 31, after the fashion shown in FIG. 2C. Contact via 32 is at this time in physical and electrical contact with the small mercury droplet 24, but because of the gap between droplets 23 and 24, is not electrically connected to via 31.

Refer now to FIG. 4A, and observe that the separation into two parts of what used to be long mercury droplet 23 has been accomplished by the heated gas 21, and that the right-hand portion (and major part of) the separated mercury has joined what used to be smaller droplet 24. Now droplet 24 is the larger droplet, and droplet 23 is the smaller. Referring to FIG. 4B, note that it is now contact vias 31 and 32 that are physically bridged by the mercury, and thus electrically connected to each other, while contact via 30 is now electrically isolated.

The LIMMS technique described above has a number of interesting characteristics, some of which we shall mention in passing. They make good latching relays, since surface tension holds the mercury droplets in place. They operate in all attitudes, and are reasonably resistant to shock. Their power consumption is modest, and they are small (less than a tenth of an inch on a side and perhaps only twenty or thirty thousandths of an inch high). They have decent isolation, are reasonably fast with minimal as contact bounce. There are versions where a piezo-electrical element accomplishes the volume change, rather than a heated and expanding gas. There are also certain refinements that are sometime thought useful, such as bulges or constrictions in the channel or the passages. Those interested in such refinements are referred to the Patent literature, as there is ongoing work in those areas. See, for example, the incorporated U.S. Pat. No. 6,323,447 B1.

To sum up our brief survey of the starting point in LIMMS technology that is presently of interest to us, refer now to FIG. 5. There is shown an exploded view of a slightly different arrangement of the parts, although the operation is just as described in connection with FIGS. 2–4. In particular note that in this arrangement the heaters (14, 15) and their cavities (16, 17) are each on opposite sides of the channel 18. A new element to note in FIG. 5 is the presence of contact electrodes 91, 92 and 93. These are thin depositions of metal that are electrically connected to the vias (30, 31 and 32, respectively) and serve to ensure good ohmic contact with the droplets of liquid metal. The droplets of liquid metal are not shown in the figure.

It would be desirable if we could take advantage of the small size and otherwise desirable characteristics of the LIMMS relays to provide an instrument grade attenuator relay usable to up to, say, eight or ten Gigahertz. What to do?

SUMMARY OF THE INVENTION

A solution to the problem of resonance within an attenuator relay caused by stray coupling capacitances to, and stray reactance within the switched conductor that replaces the attenuator section, is to ensure that the stray coupling capacitances are diminished to as low a value as possible, and to ensure that the conductor is a section of controlled impedance transmission line that matches the system into which the attenuator relay has been placed. A substrate having SPDT LIMMS switches on either side of a switched transmission line segment and its associated attenuator, all of which are fabricated on the substrate, will have significantly lower stray coupling capacitance across the open parts of the switches when the attenuator segment is in use. This will increase the frequency for the onset of the resonance driven by the RF voltage drop across the attenuator. A reduction in the amplitude of the resonance can be obtained by including on the substrate an additional pair of SPST or SPDT LIMMS damping switches at each end of the transmission line segment. These damping switches each connect a terminating resistor to the ends of the transmission line segment when the attenuator section is in use. This loads the resonator and reduces the amplitude of the resonance. Still further improvement can be obtained by locating one of the damping switches and its termination resistor near (but preferably not exactly at) the middle of the transmission line segment.

DESCRIPTION OF A PREFERRED EMBODIMENT

Figure 6:
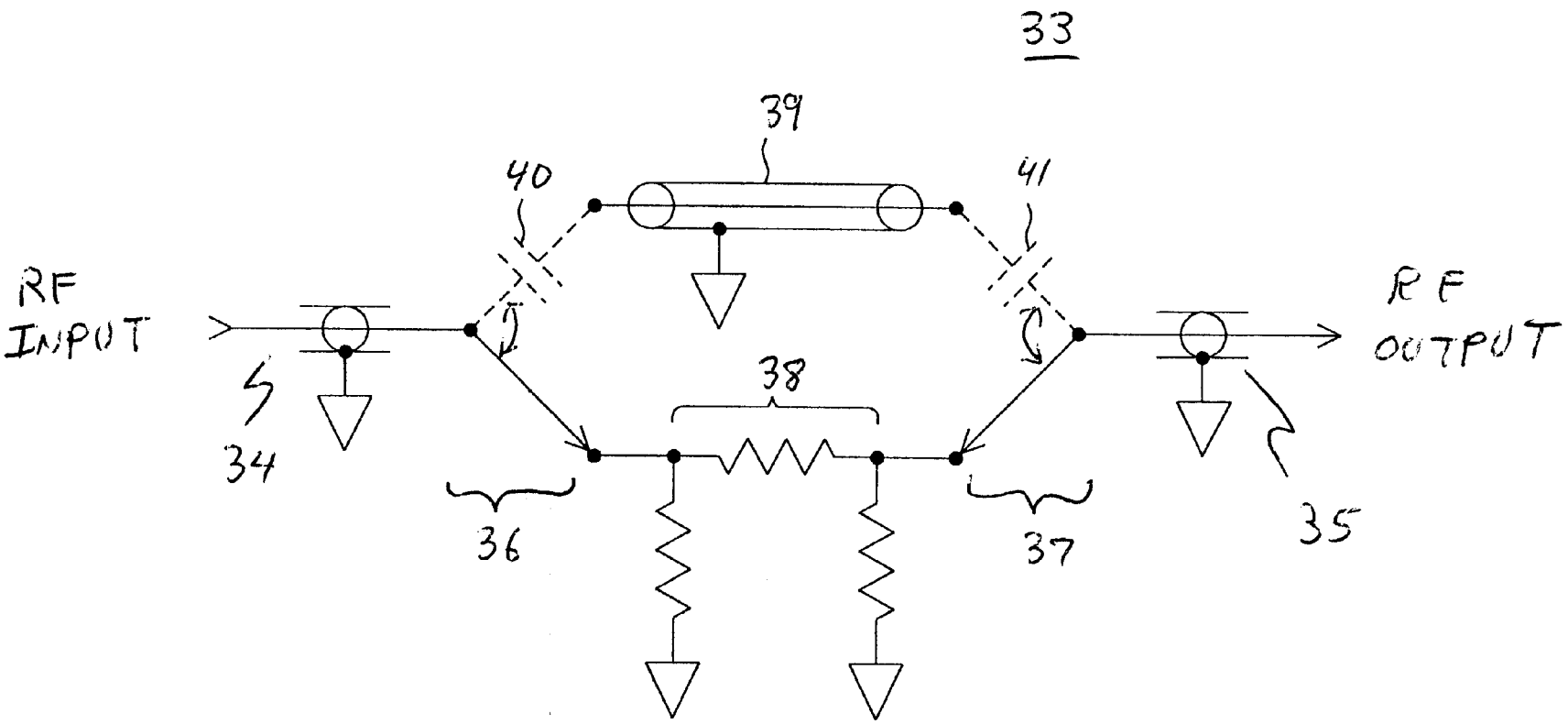
FIG. 6 is a simplified schematic segment of an improved attenuator relay.

Refer now to FIG. 6, wherein is shown a simplified schematic segment of a step attenuator relay 33 having an RF Input 34 coupled to an RF Output 35 through either an attenuator section 38 or through a section or segment of genuine controlled impedance transmission line 39. The characteristic impedance $Z_0$ of the transmission line segment 39 is the same as that which delivers the RF signal to the RF Input 34, and which receives it from RF Output 35, and would most typically be 50Ω, although other values such as 75Ω and 100Ω are certainly possible. The path from the RF Input to the RF Output (either through 38 or through 39) is selected by relays 36 and 37, which are preferably SPDT LIMMS switches fabricated on a substrate (not separately shown—the whole of FIG. 6 is on the substrate), which also carries the attenuator 38 and transmission line segment 39. Although the attenuator 38 is shown as being a "pi" section, and it will be readily appreciated that other attenuator sections, such as "L" and "T" can be used in place of the "pi" section, and that indeed, filter mechanisms could be used instead, also. It will further be understood that LIMMS switches or relays 36 and 37 are, while not physically ganged together by a mechanical linkage, they nevertheless are operated together, in unison, and are either both thrown to connect to the attenuator 38 or are both thrown to connect to the transmission line segment 39. The overall operation of the step attenuator relay 33 is thus clear. It either by-passes a disconnected attenuator section 38 with the transmission line segment 39, or it inserts the attenuator section 38 in place of the transmission line.

Now, the technique of FIG. 6 (using LIMMS relays on a substrate to switch between RF circuits formed on the substrate) is a good one, and is capable of good performance for many applications. It is, however, not entirely free of the mischief that we noted in connection with the prior art A150 attenuator relay from Teledyne. The problem is that during attenuation (switches 36 and 37 thrown as shown in the figure) there are still significant stray capacitances 40 and 41 that will couple energy into the transmission line segment 39, using the voltage developed across the attenuator section 38 as a source. Any impedance for the path between the two stray capacitances 40 and 41 is in parallel with the attenuator. If it is fairly high it won't matter. But at series resonance it can be quite low, and will shunt the attenuator in a frequency dependent manner. This can poison the operation of the attenuator, which may be undesirable if it happens within a frequency range of interest. The good news is that these stray capacitances are very much reduced from what they were in the A150; down to about 30 fF from about 100 fF. That reduction arises from use of the LIMMS. Furthermore, over the frequency range of interest, anyway, a transmission line of uniform $Z_0$ (39, and as opposed to a collection of stray reactances along a bare conductor) means that resonance of the transmission line is more predictable. It is also not unreasonable to expect that the resonance, when it does occur, is at a higher frequency than if the stray capacitances 40 and 41 were higher and there were stray reactances along a bare conductor. So, the circuit of FIG. 6 is a good one. But it relies heavily on reductions in the stray capacitances 40 and 41, which at present are, despite being reduced by the use of LIMMS, still present in amounts too large to ignore altogether. On the other hand, future development in LIMMS may well produce units that have extremely little stray capacitance across their open contacts.

A word is in order about the transmission line segment 39. It is fabricated on a substrate, most likely a ceramic one, using known techniques, which include but are not limited to, strip lines, co-planar lines, and quasi-coaxial transmission lines (as taught in U.S. Pat. No. 6,255,730 B1, entitled AN INTEGRATED LOW COST THICK FILM MODULE and issued Jul. 3, 2001).

Finally, it will be appreciated that although we have shown a transmission line segment and an attenuator section in FIG. 6, we could also use any of the following combinations of RF circuits: two attenuators sections; a filter section and a transmission line section; or, two filters.

Figure 7:
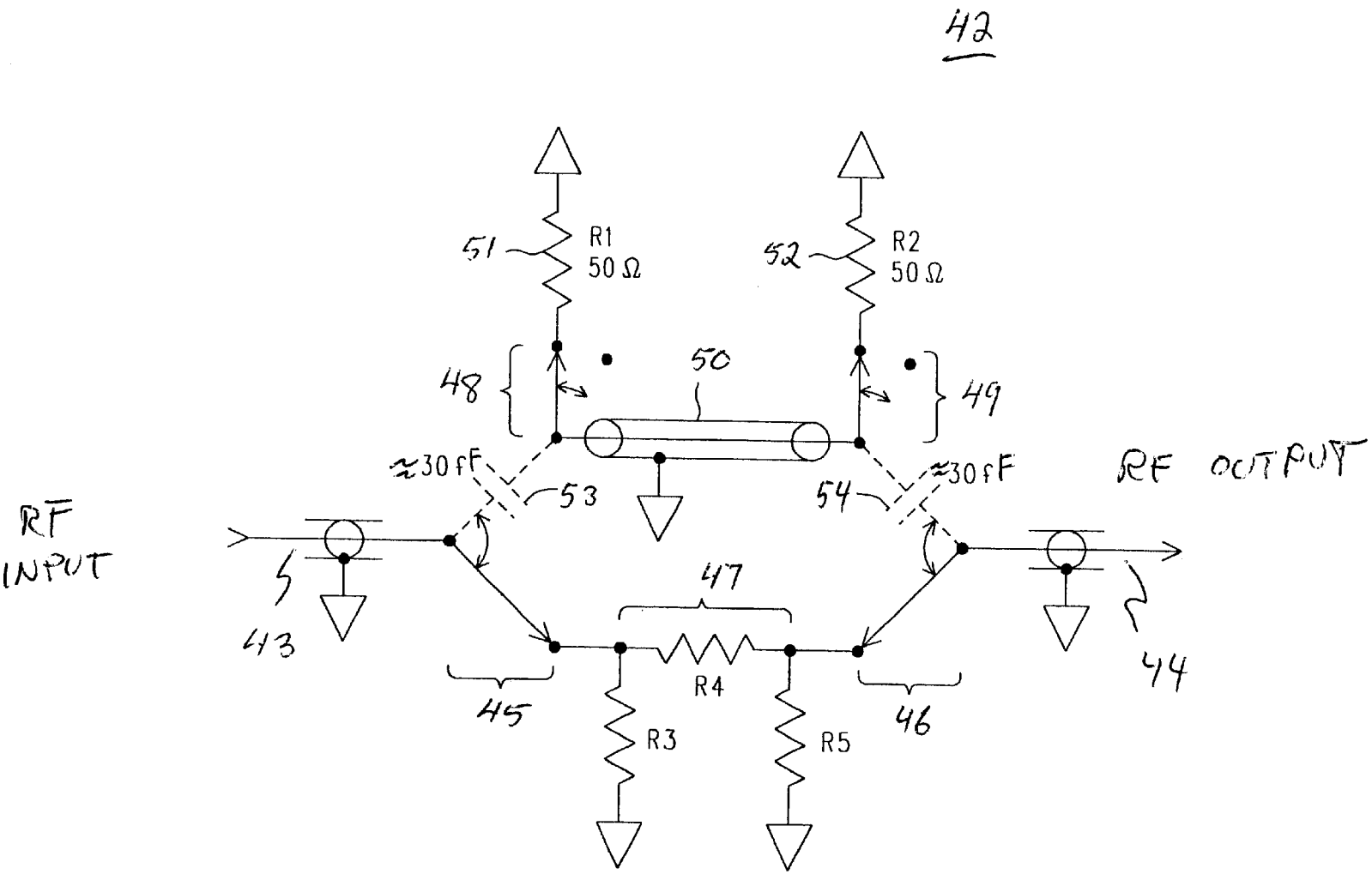
FIG. 7 is a simplified schematic segment of a further improved attenuator relay with switched resonance damping.

Now refer to FIG. 7, which is a simplified schematic segment of an improved step attenuator relay 42. As in the relay 33 of FIG. 6, it also has an RF Input 43 and an RF Output 44, between which are an attenuator section 47 and a transmission line segment 50, one of which is selected by LIMMS 45 and 46 to be the path through the relay 42. As in FIG. 6, we are confronted with the approximately 30 fF each for stray capacitances at 53 and 54. In this application we are interested in maximizing the usable bandwidth of the step attenuator relay 42. We wish to do what else might be done to diminish the effects of resonance in transmission line segment 50.

A further reduction in the amplitude of the resonance of transmission line 50 (again, when the attenuator 47 is selected as the through path) can be achieved by including LIMMS switches (relays) 48 and 49. They are, as are LIMMS switches 45 and 46, arranged to throw together as shown, and be as shown when switches 45 and 46 are as shown. In the case shown (attenuation by section 47 is selected), termination resistors R1 (51) and R2 (52) are connected to the outside ends of the transmission line segment 50. All four switches (45, 46, 48, 49) throw in unison, so that when the transmission line segment 50 is selected as the through path, the termination resistors 51 and 52 are not connected to the ends of the transmission line segment 50. It will be appreciated that what the termination resistors do is dampen any oscillatory resonance involving the transmission line segment 50. The preferred ohmic values for the termination resistors R1 and R2 is that which equals the characteristic impedance $Z_0$ of the transmission line segment 50. That broadens the resonant peak and increases the impedance at resonance that attempts to shunt the attenuator section 38. The result is less disturbance to the operation of the attenuator, as seen from the RF Input 34 to the RF Output 35.

It will be appreciated that, as was the case for FIG. 6, the entire step attenuator relay 42 of FIG. 7 can be (and is preferred to be) fabricated on a substrate.

Figure 8:
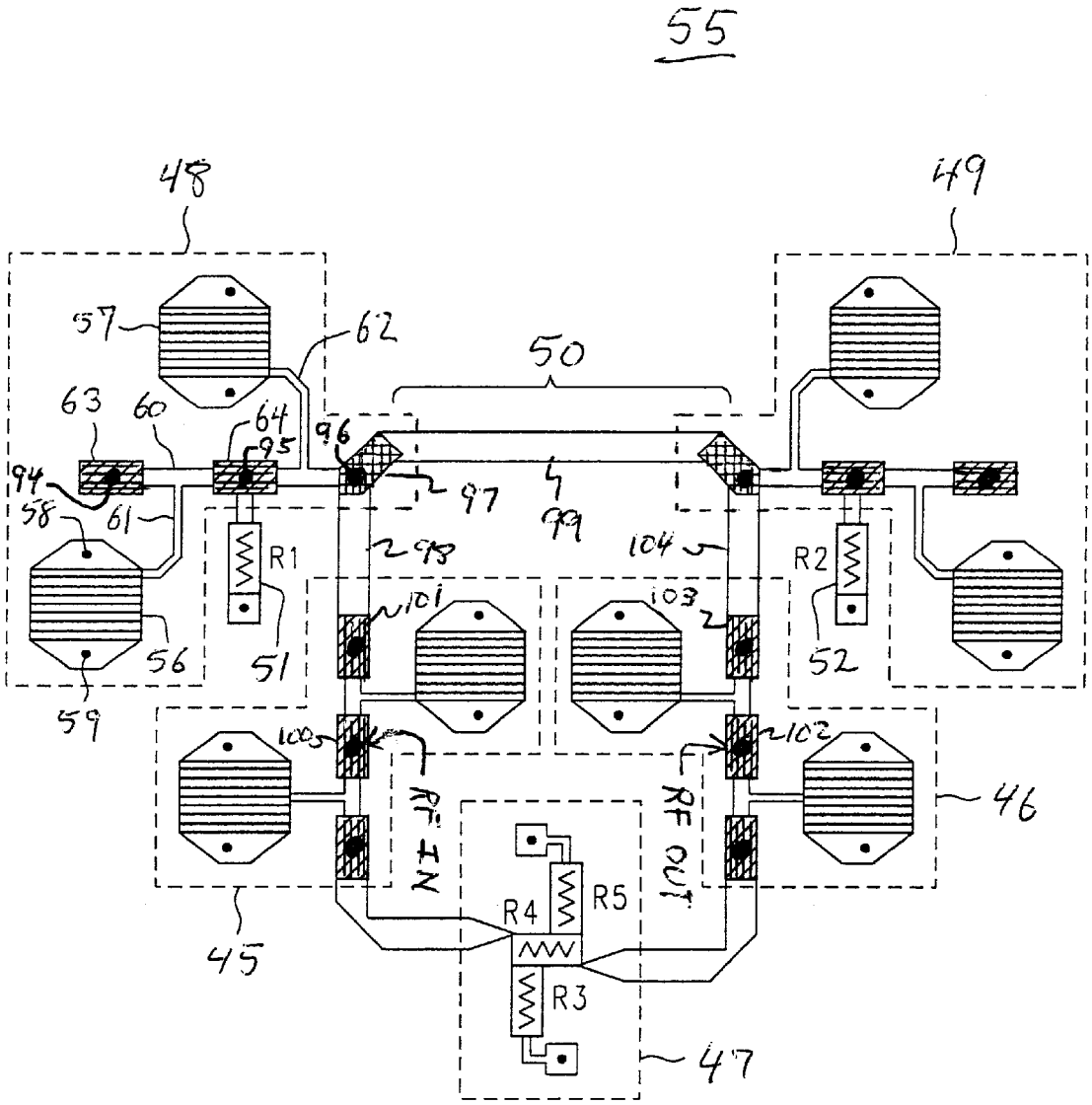
FIG. 8 is a simplified mask diagram of a substrate upon which the circuit of FIG. 7 has been fabricated.

Now refer to FIG. 8, which is a simplified mask diagram 55 of materials deposited upon a substrate (not separately shown—it's everywhere) to implement the step attenuator circuit 42 of FIG. 7. To this end, like items have the same reference characters in both figures, although there are some additional reference characters that have been added to FIG. 8. We shall have some things to say about FIG. 8, but on the whole, the nature of the layout is quite in keeping with what was said about LIMMS in FIGS. 2–5, and will easily be understood as corresponding exactly to FIG. 7.

Figure 1:
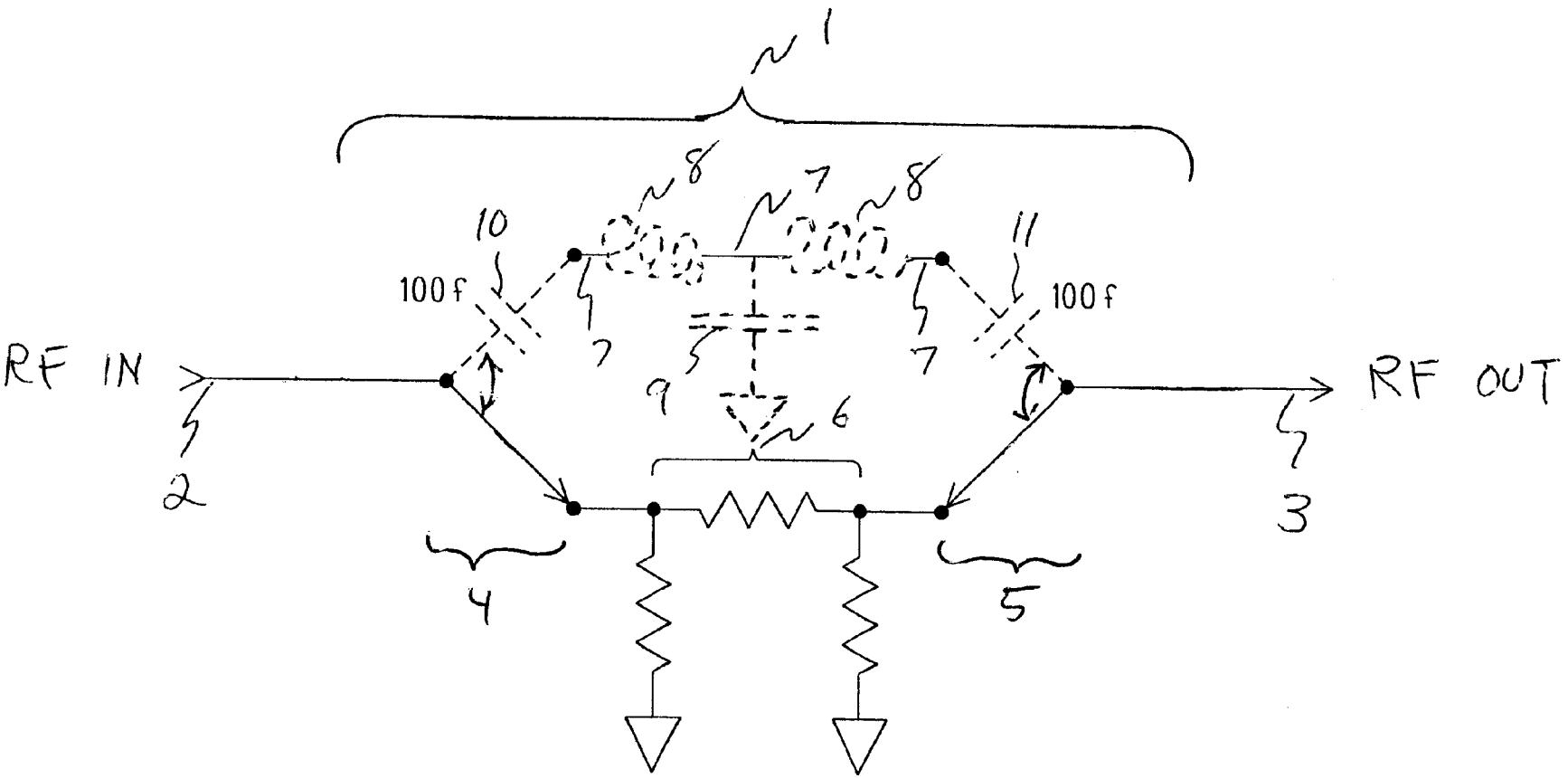
FIG. 1 PRIOR ART
FIG. 1 is a simplified schematic section depicting a prior art attenuator relay.
Figure 2A:
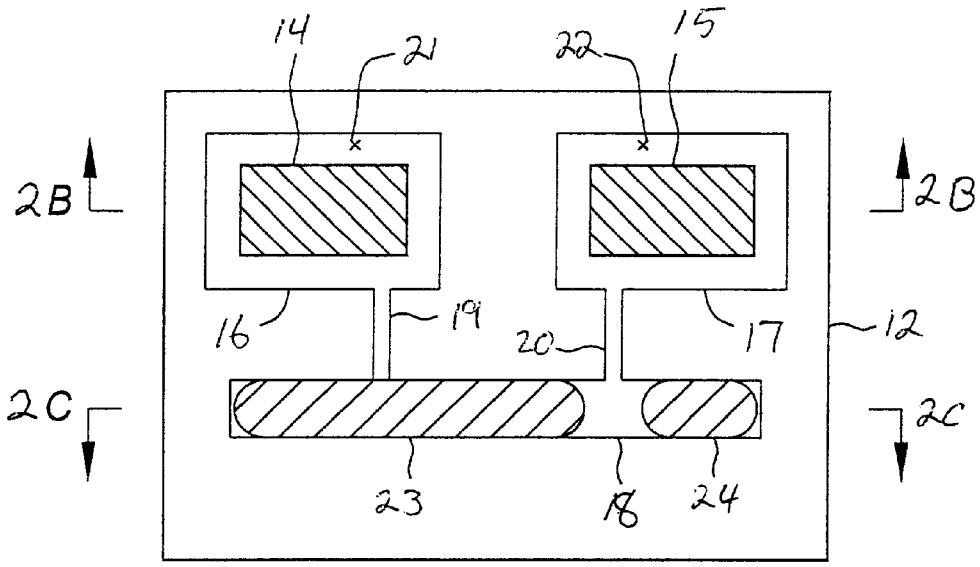
FIG. 2A PRIOR ART
FIGS. 2A–C are various sectional views of a prior art SPDT Liquid Metal Micro Switch (LIMMS), and wherein for convenience, while the heaters are shown as located on opposite ends of the channel, they are also shown as being on the same side thereof.
Figure 2B:
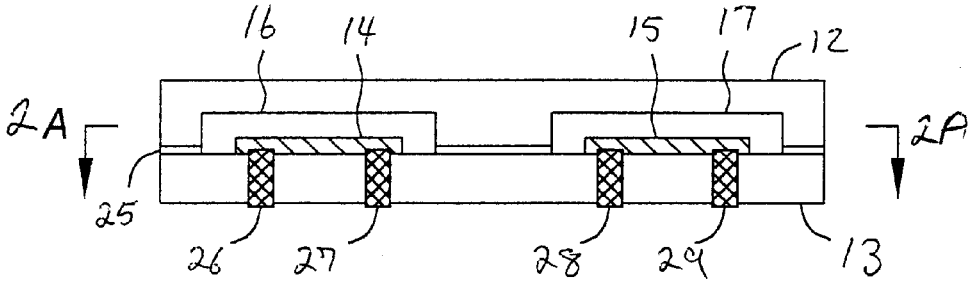
FIG. 2B PRIOR ART
Figure 2C:
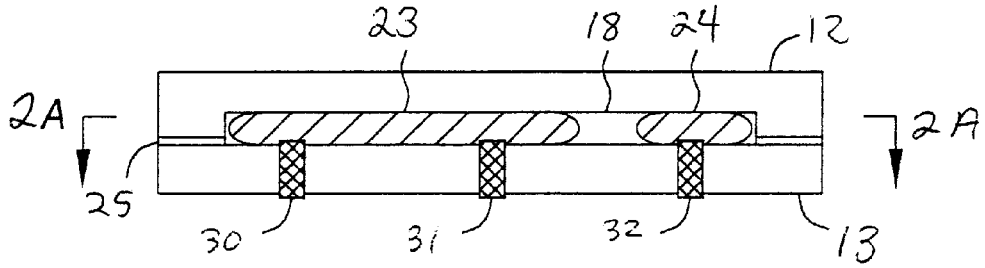
FIG. 2C PRIOR ART
Figure 3:
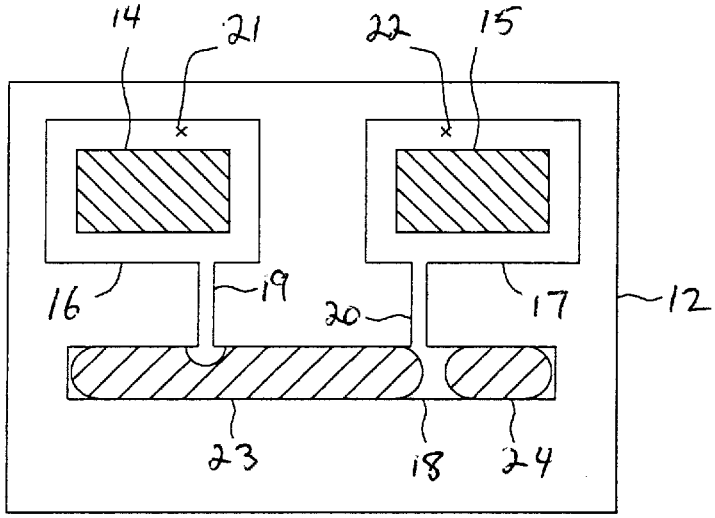
FIG. 3 PRIOR ART
FIG. 3 is a sectional view similar to that of FIG. 2A, at the start of an operational cycle.
Figure 4A:
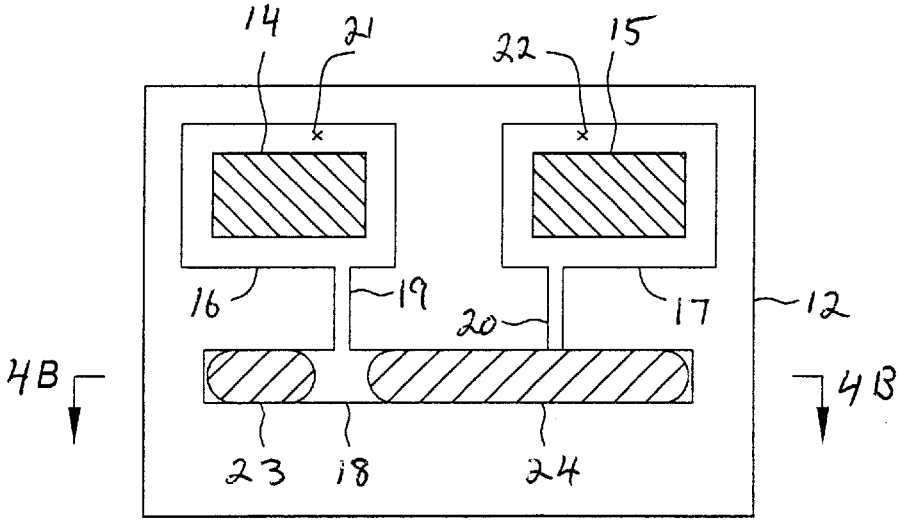
FIG. 4A PRIOR ART
FIGS. 4A–B are sectional view of the LIMMS of FIGS. 2A–C at the conclusion of the operation begun in FIG. 3.
Figure 4B:
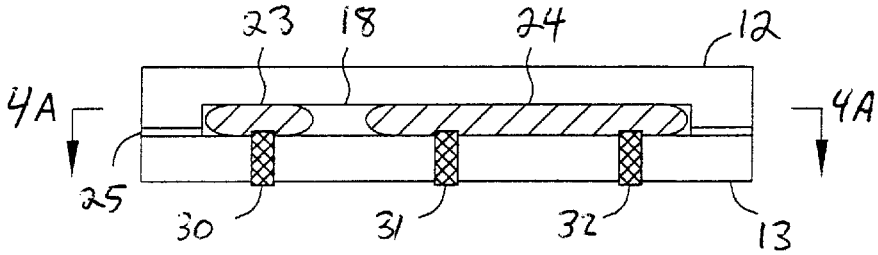
FIG. 4B PRIOR ART
Figure 5:
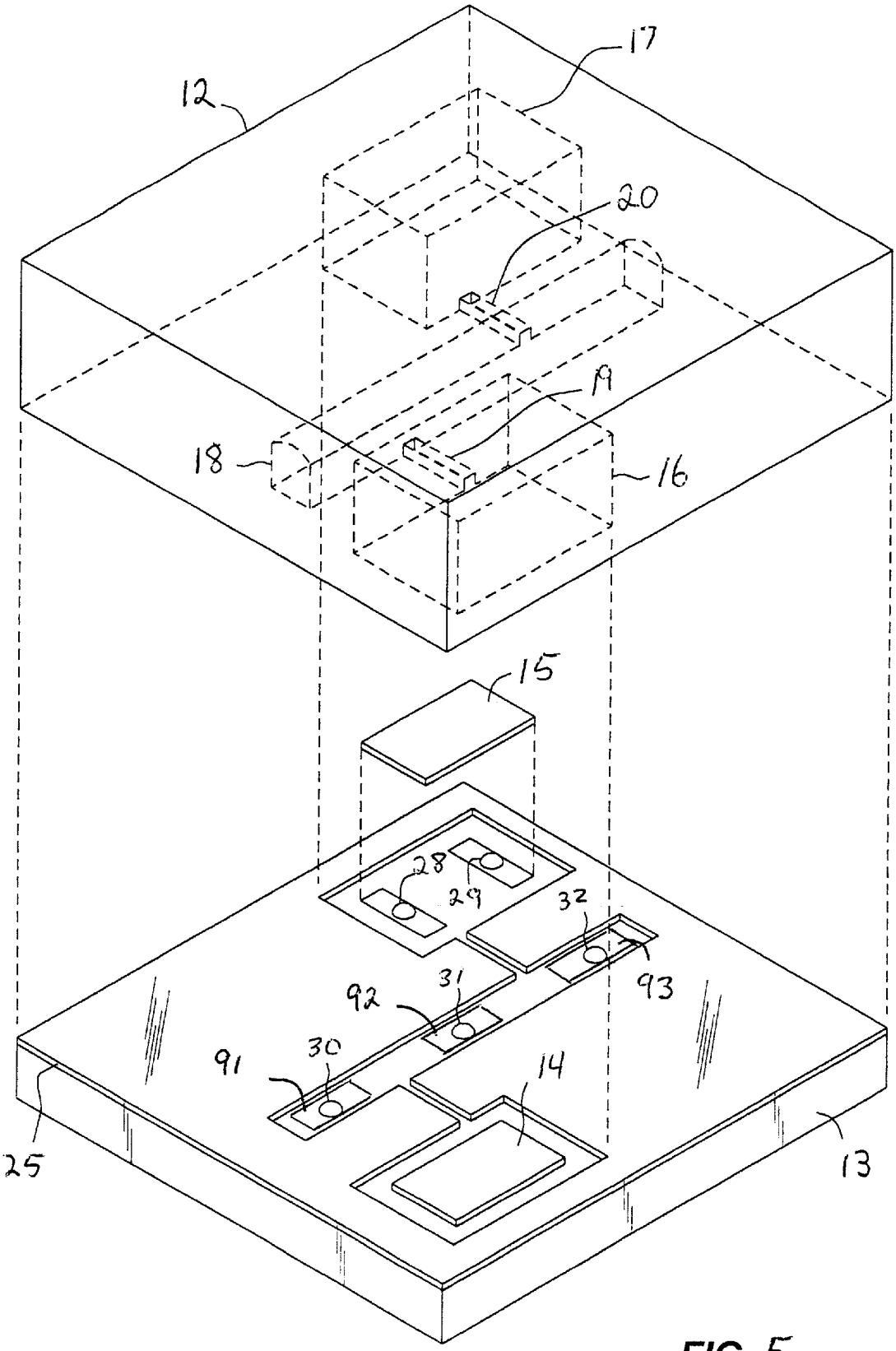
FIG. 5 PRIOR ART
FIG. 5 is an exploded view of a SPDT LIMMS similar to what is shown in FIGS. 2–4, but where the heaters are disposed on both opposite sides and on opposite ends of the channel.

It is preferred that the entire circuit 55 of FIG. 8 be fabricated upon a single substrate, and that there be a single cover block (not shown) whose internal passages match the stuff in FIG. 8 the same way the cover block 12 matches the stuff on substrate 13 of FIG. 5. It is more complicated, but is just more of the same, with the exception that where it covers the transmission line segment 50 its dielectric constant figures into how $Z_0$ is obtained (i.e., it influences the width of the "center conductor" (99) of transmission line 50, as does the thickness and dielectric constant of the substrate). Also, since element 50 is to be a transmission line, and for good electrical shielding in general, there is almost certainly (and preferably there is) a ground plane on the underside of the substrate. It is not separately shown, either, since, like the substrate it is formed on, it goes everywhere, except for where there is a via for interconnect purposes.

In FIG. 8 the small rectangular cross hatched regions (e.g., 63, 64, 97, . . . ) are electrodes for making contact with the liquid metal in the channel of a LIMMS structure. Underneath each will be a via, as indicated by the black dots 94–96; compare with elements 30–32 and 91–93 in FIG. 5, to which these items correspond. Note channel 60 between contact electrodes 63 and 64, and extending to contact electrode 97. Channel 60 in the figure represents the path that the mercury droplets use as they shuttle back and forth. It is a region on the substrate that has no CYTOP seal (which for clarity is not otherwise shown, anyway), and also represents the intended location and relative width of the corresponding channel in the cover block. The contact electrodes (63, 64, 97, . . . ) are shown as slightly wider than the channel 60 to facilitate proper operation even if there should be some slight mis-registration of the cover block during assembly.

Another aspect of FIG. 8 that is of interest is how it has been arranged to minimize the a, disturbance to the transmission line segment 50 when it is in use in place of the attenuator section 47. That is, when contact electrodes 100 and 101 in switch 45 are connected, and contact electrodes 102 and 103 in switch 46 are connected. Then conductive path 98, 99, 104 performs the desired substitution for the attenuator 47. Segments 98 and 99 may be part of the controlled impedance transmission line 50, which at a minimum includes conductor 99. Also under the stated circumstances (no attenuation), the large mercury droplet in switch 48 will bridge conductive electrodes 63 and 64, but not 64 and 97. The small mercury droplet remains in contact with electrode 97, however. In order that its physical presence does not create a stub or other discontinuity, the shape of the contact electrode 97, and that of the mercury channel (60) in the vicinity of that electrode, have been arranged to fall within the geometry of the transmission line. In the example shown, that means that the channel 60 has a bend in it to conform with the change in direction between conductors 98 and 99. That is, the small droplet will be a part of the transmission line 50, and not act as a "tee" ending in a stub. That is, the small droplet is small enough that it all fits on the electrode 96 side of the bend. On the other hand, when the large droplet is in that position it does extend around the bend, but in that case it is entirely proper that it does so (it has to make contact with electrode 64). A similar arrangement exists for switch 49 where it connects to transmission line 50.

Present experience indicates that the slight local increase in cross section of the center conductor of the transmission line segment produced by the small mercury droplet being over contact electrode 97 does not produce an adverse inductive discontinuity up through the eight to ten Giga Hertz frequencies in use with this attenuator relay. This appears to be because the diameter of the mercury droplet is so small. At higher frequencies this might not continue to be so, and compensatory adjustments in other geometric/electric aspects of the transmission line at that location might be desirable to preserve a uniform characteristic impedance.

Finally, note elements 56 and 57. These are the heaters that operate switch 48, and are depicted with parallel hatching. The other heaters for the remaining switches are similarly indicated. Dots 58 and 59 represent the vias that connect to the heaters. Elements 61 and 62 are the gas passages that connect the cavities in the cover block to the channel 60.

Figure 9:
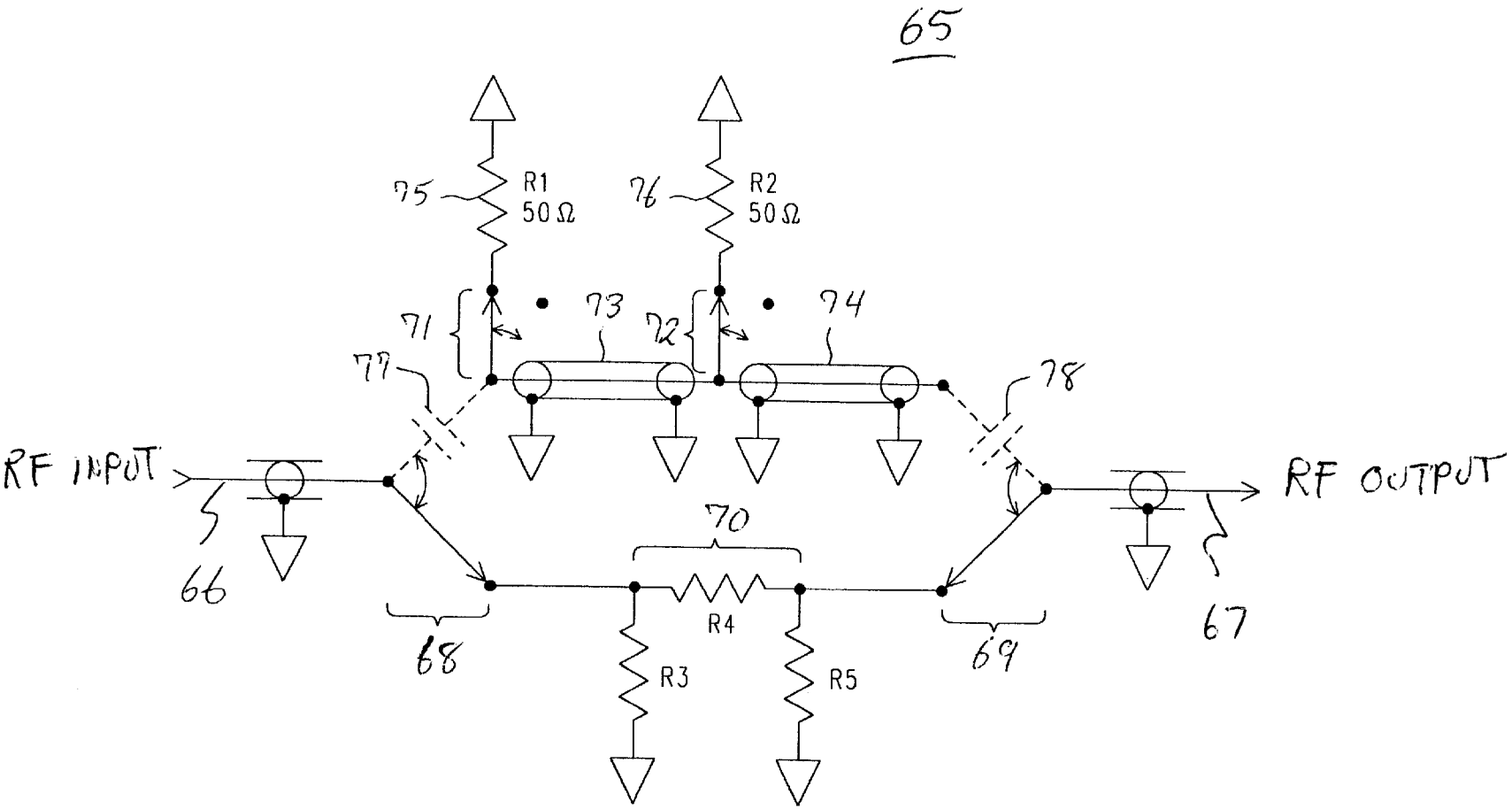
FIG. 9 is a simplified schematic segment of an even further improved attenuator relay with more effective resonance damping.

Refer now to FIG. 9, which is a simplified schematic for an improved version 65 of the step attenuator relay of FIG. 7. The arrangement is the same in most respects, save that in FIG. 9 damping resistor R2 (76) and its associated switch 72 are located near (but preferably not exactly at) the middle of the transmission line segment, which is then divided into portions 73 and 74. The reason that an off center location is preferred is that at resonance, there is a maximum at either end and a zero at the very center of the transmission line segment. A termination at the exact middle will thus be ineffective, and needs instead to be located somewhat away from the middle. Those familiar with transmission line resonators will appreciate that this internal termination of the transmission line has the effect of directly damping a higher mode of oscillation than is obtained merely by loading the ends of the transmission line.

As for the balance of FIG. 9, its correspondence with FIG. 7 is quite clear. RF inputs 43 and 66 correspond, as do RF outputs 67 and 44. Attenuator sections 47 and 70 correspond, as do switches 45 and 68, switches 46 and 69, and switches 48 and 71. Capacitances 53 and 54 correspond to 77 and 78.

Figure 10:
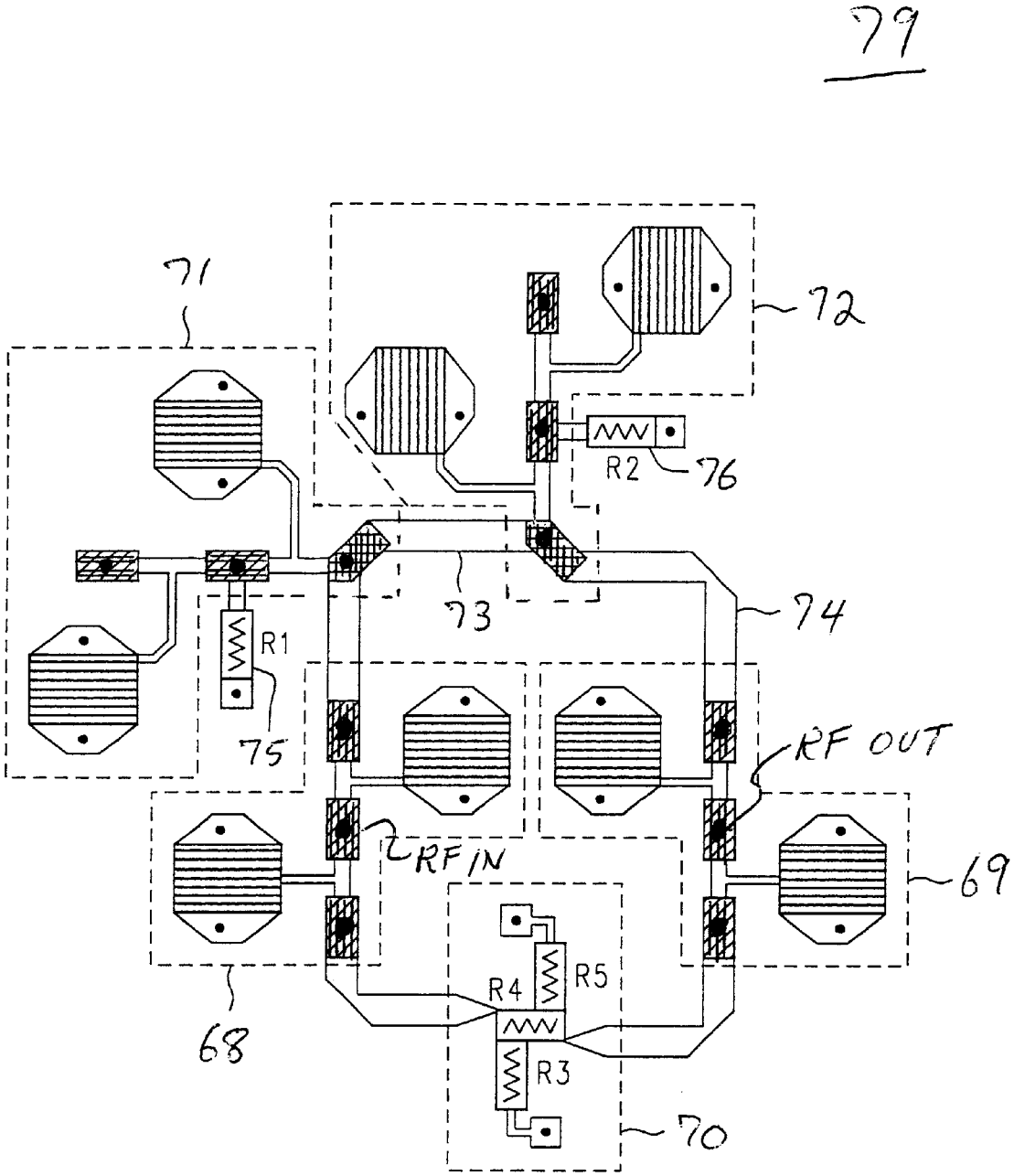
FIG. 10 is a simplified mask diagram of a substrate upon which the circuit of FIG. 9 has been fabricated.

FIG. 10 is a simplified mask diagram 79 that corresponds to the circuit of step attenuator relay 65 of FIG. 9. It employs the same conventions as were used in FIG. 8, and requires no further explanation.

Figure 11:
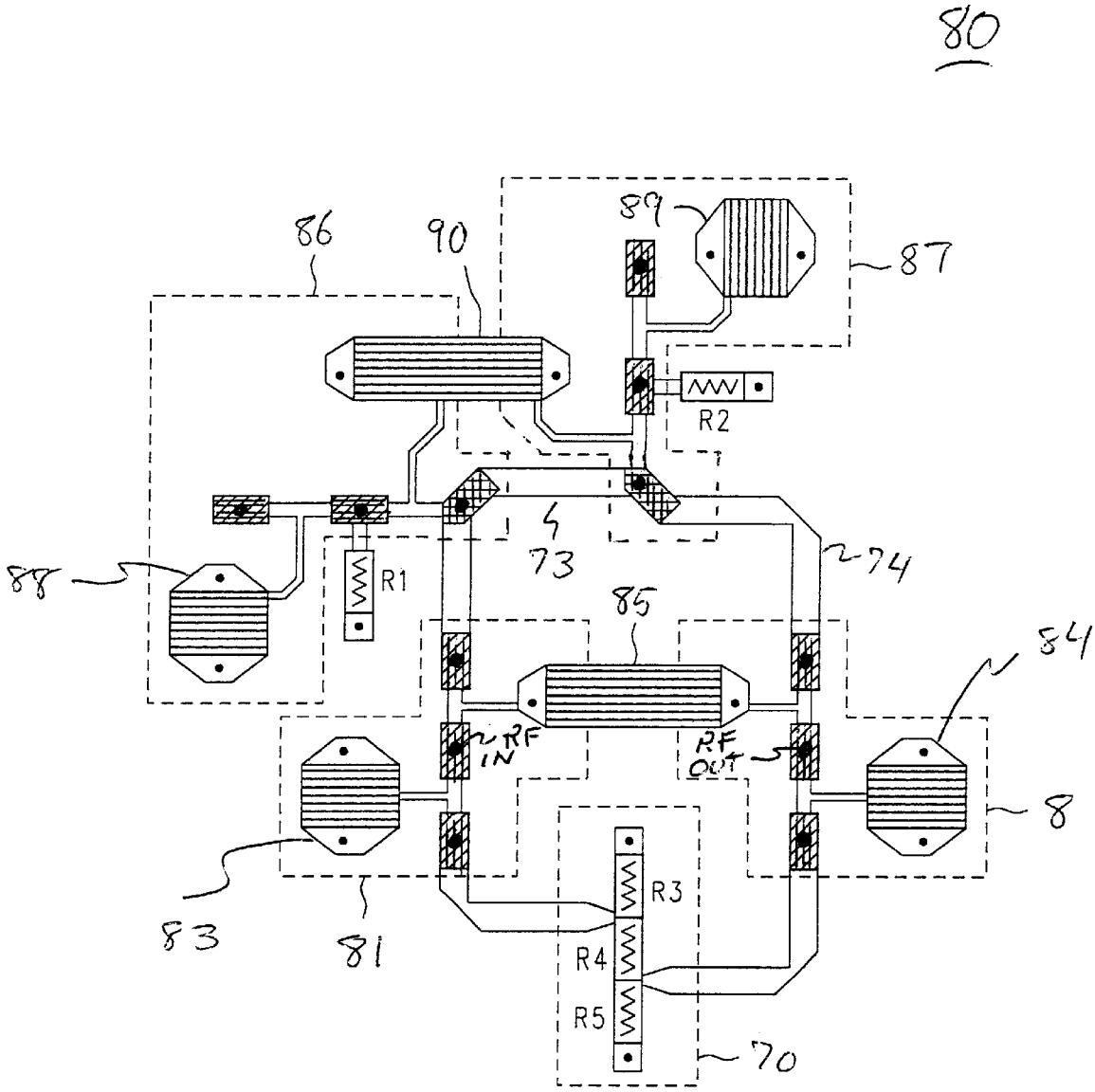
FIG. 11 is a simplified mask diagram of a substrate similar to that depicted in FIG. 10, except that the LIMMS share certain common heater resistors.

Finally, FIG. 11 is a simplified mask diagram 80 of yet another improvement to the structures shown in FIGS. 8, 9 and 10. FIG. 11 also employs the same conventions as were used in connection with FIG. 8, although its circuit arrangement most closely corresponds to that of FIGS. 9 and 10. It will noted that switches 81 and 82 select between a path using attenuator 70 or transmission line segments 73 and 74. The difference is that switches 83 and 84 share a heater resistor 85, and switches 86 and 87 share a heater resistor 90. Heater resistors 83 and 84 remain separate, although it is clear that, in principle, they could be replaced by a common resistor, as well, as could separate resistors 88 and 89. This sharing of heater resistors is made possible because the LIMMS switches in this application are "ganged" to throw together in a certain pattern.

We claim:

1. An RF relay comprising:

a substrate;

a first SPDT LIMMS formed upon the substrate and whose moving pole is an RF input;

a second SPDT LIMMS formed upon the substrate and whose moving pole is an RF output;

the first and second LIMMS ganged to operate in unison, such that the moving pole of each LIMMS contacts a respective first throw of that LIMMS when operated in one direction, and the moving pole of each LIMMS contacts a respective second throw of that LIMMS when operated in another direction;

a first RF circuit formed upon the substrate and coupled between the first throw of the first LIMMS and the first throw of the second LIMMS; and a second RF circuit formed upon the substrate and coupled between the second throw of the first LIMMS and the second throw of the second LIMMS.

2. An RF relay as in claim 1 wherein one of the first and second RF circuits is an attenuator section.

3. An RF relay as in claim 1 wherein one of the first and second RF circuits is a length of controlled impedance transmission line.

4. An RF relay as in claim 1 wherein the first RF circuit is an attenuator section and the second RF circuit is a length of controlled impedance transmission line.

5. An RF relay as in claim 1 wherein both the first and second RF circuits are attenuator sections.

6. An RF relay as in claim 1 wherein one of the first and second RF circuits is a filter.

7. An RF relay comprising:

a substrate;

a first SPDT LIMMS formed upon the substrate and whose moving pole is an RF input;

a second SPDT LIMMS formed upon the substrate and whose moving pole is an RF output;

the first and second LIMMS ganged to operate in unison, such that the moving pole of each LIMMS contacts a respective first throw of that LIMMS when operated in one direction, and the moving pole of each LIMMS contacts a respective second throw of that LIMMS when operated in another direction;

an RF circuit formed upon the substrate and coupled between the first throw of the first LIMMS and the first throw of the second LIMMS;

a third LIMMS formed upon the substrate and whose moving pole is a coupled to the second throw of the first LIMMS;

a fourth LIMMS formed upon the substrate and whose moving pole is coupled to the second throw of the second LIMMS;

the third and fourth LIMMS ganged to operate in unison, such that the moving pole of each contacts a respective first throw of each when operated in one direction, and each moving pole does not contact the respective first throw of each when operated in another direction;

a length of controlled impedance transmission line coupled between the moving pole of the third LIMMS and the moving pole of the fourth LIMMS; and a first termination resistance coupled between an RF ground and the first throw of the third LIMMS; and a second termination resistance coupled between RF ground and the first throw of the fourth LIMMS.

8. An RF relay as in claim 7 wherein the RF circuit is an attenuator section.

9. An RF relay comprising:

a substrate;

a first SPDT LIMMS formed upon the substrate and whose moving pole is an RF input;

a second SPDT LIMMS formed upon the substrate and whose moving pole is an RF output;

the first and second LIMMS ganged to operate in unison, such that the moving pole of each LIMMS contacts a respective first throw of that LIMMS when operated in one direction, and the moving pole of each LIMMS contacts a respective second throw of that LIMMS when operated in another direction;

an RF circuit formed upon the substrate and coupled between the first throw of the first LIMMS and the first throw of the second LIMMS;

third and fourth LIMMS each formed on the substrate and ganged to operate in unison, such that the moving pole of each those LIMMS contacts a respective first throw of that LIMMS when operated in one direction, and the moving pole of each of those LIMMS's does not contact the respective first throw of that LIMMS when operated in another direction;

the second throw of the first LIMMS coupled to the moving pole of the third LIMMS;

a first length of controlled impedance transmission line coupled between the moving pole as of the third LIMMS and the moving pole of the fourth LIMMS;

a second length of controlled impedance transmission line coupled between the moving pole of the fourth LIMMS and the second throw of the second LIMMS;

the first and second LIMMS ganged with the third and fourth LIMMS to operate such that when the moving pole of one of the first and second LIMMS contacts its respective first throw the moving poles of the third and fourth LIMMS contact their respective first throws;

a first termination resistance coupled between an RF ground and the first throw of the third LIMMS; and a second termination resistance coupled between RF ground and the first throw of the fourth LIMMS.

10. An RF relay as in claim 9 wherein the RF circuit is an attenuator section.

* * * * *